US005595228A

United States Patent [19]

Meisner et al.

[11] Patent Number: 5,595,228

[45] Date of Patent: Jan. 21, 1997

[54] UTILITY BOX INCORPORATING AN INTEGRAL CLAMPING VISE

[75] Inventors: Edward H. Meisner, Short Hills, N.J.; Keith Kristiansen, Stratford, Conn.; Michael Ballone, New Providence, N.J.; Roberta S. Hall, Sparks; Michael A. Loferski, Monkton, both of Md.; Michael D. Dolson, Millbrook, Canada; Christopher Bennett, Whitby, Canada; John B. Manson, Sr.; Frank Basten, both of Brockville, Canada; Colin Overy, North Augusta, Canada

[73] Assignee: Black & Decker Inc., Newark, Del.

[21] Appl. No.: 289,676

[22] Filed: Aug. 12, 1994

[51] Int. Cl.[6] ..... B25H 1/12; B65D 85/20

[52] U.S. Cl. ..... 144/285; 206/216; 206/373

[58] Field of Search ..... 144/285, 286 R, 144/287; 269/16, 139, 219; 206/216, 349, 373, 374

[56] References Cited

U.S. PATENT DOCUMENTS

| | | | |
|---|---|---|---|
| 198,092 | 12/1877 | Erlebach | 144/285 |
| D. 253,212 | 10/1979 | Maruscak . | |
| D. 263,533 | 3/1982 | Ferdinand et al. . | |
| D. 288,867 | 3/1987 | Cadwallader . | |
| 564,782 | 7/1896 | Doelger . | |
| 1,063,046 | 5/1913 | Lathrop | 144/285 X |

(List continued on next page.)

FOREIGN PATENT DOCUMENTS

| | | |
|---|---|---|
| 427500 | 4/1926 | Germany . |
| 8702845 | 11/1987 | Netherlands . |
| 2164599 | 3/1986 | United Kingdom . |
| 2233885 | 1/1991 | United Kingdom . |
| 2267674 | 12/1993 | United Kingdom . |
| 2241940 | 9/1994 | United Kingdom . |

*Primary Examiner*—Bryon P. Gehman
*Attorney, Agent, or Firm*—Harness, Dickey & Pierce, P.L.C.

[57] ABSTRACT

A utility box for storing and/or carrying articles to a remote site has a base and a cover with a clamping vise incorporated as an integral portion of the cover. The base is a box-like structure defining a chamber for holding the articles and having a set of four pedestals which provide a supporting structure for the integral vise. The base further includes an integral pair of clamping feet which extend from two of the pedestals to form a surface which can be used to clamp the utility box to a relatively stationary surface. The cover is hingedly secured to the base and mates with a positioning rib extending from the base in order to locate and position the cover with respect to the base. The integral vise defines a worksurface and includes a stationary jaw and a movable jaw. The movable jaw is movable via a pair of threaded rods which are rotatably mounted to the cover. Additional features of the utility box include and externally accessed parts tray having a clear plastic cover and an internally nested auxiliary parts tray to facilitate the internal organization of the utility box. Additional embodiments of the invention include a plurality of support legs to position the utility box at a predetermined height and a drawer support to provide additional storage and to also position the tool box at a predetermined height.

130 Claims, 9 Drawing Sheets

U.S. PATENT DOCUMENTS

| | | | |
|---|---|---|---|
| 1,268,124 | 6/1918 | Jennings . | |
| 1,740,470 | 12/1929 | Mack | 144/285 |
| 1,987,822 | 1/1935 | Gregory | 206/373 X |
| 2,011,197 | 8/1935 | Mordt | 144/285 |
| 2,094,805 | 10/1937 | Meier . | |
| 2,122,969 | 7/1938 | Whitcomb . | |
| 2,504,722 | 4/1950 | Owens | 144/285 |
| 2,759,507 | 8/1956 | Davis et al. . | |
| 2,786,500 | 3/1957 | Unterfranz . | |
| 2,791,251 | 5/1957 | Steele, Jr. | 144/285 |
| 2,799,306 | 7/1957 | Martin . | |
| 3,018,355 | 1/1962 | Wallerstein | 144/285 |
| 3,615,087 | 10/1971 | Hickman | 144/287 X |
| 3,746,210 | 7/1973 | Evans | 206/349 X |
| 3,851,756 | 12/1974 | Brown . | |
| 4,061,323 | 12/1977 | Beekenkamp | 269/139 |
| 4,239,195 | 12/1980 | Oltman et al. . | |
| 4,256,294 | 3/1981 | Hickman et al. . | |
| 4,278,243 | 7/1981 | Alessio . | |
| 4,303,158 | 12/1981 | Perkins | 206/373 |
| 4,378,828 | 4/1983 | Shiminski . | |
| 4,460,085 | 7/1985 | Jantzer | 206/349 |
| 4,909,491 | 3/1990 | Cheng . | |
| 4,911,296 | 3/1990 | Hart, Jr. | 206/373 |
| 5,011,013 | 4/1991 | Meisner et al. . | |
| 5,117,979 | 6/1992 | Brightbill . | |
| 5,193,706 | 3/1993 | Hanna et al. . | |

10
16
104
17
136
134
112
102
114
115
138
133
130
64
12
14
70
32
132
32
42
45
47
50
16

10
102
132
100
14
32
32
64
70
12
48
48
46
46
50

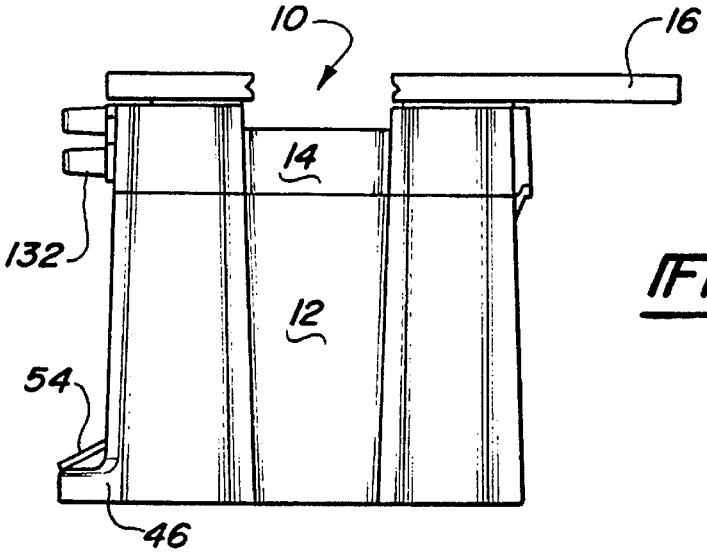
Fig-5
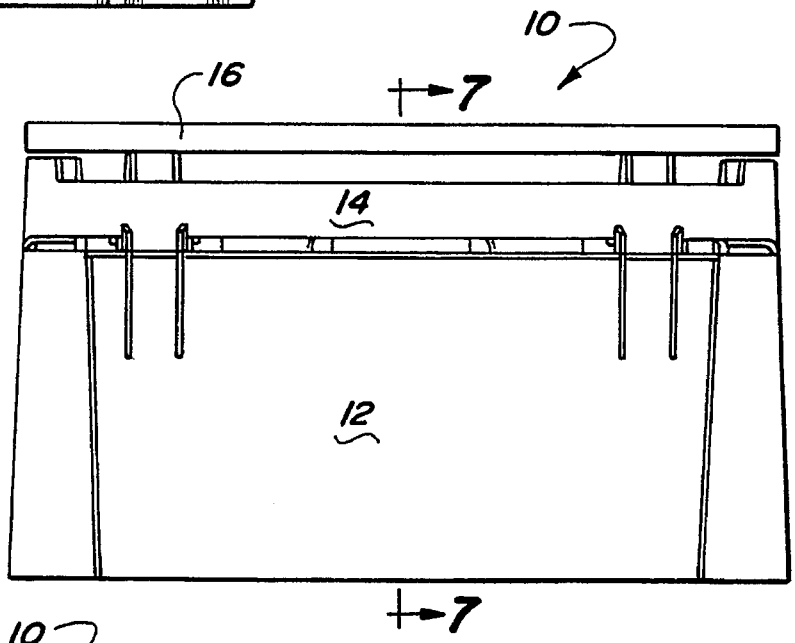
Fig-6
Fig-7
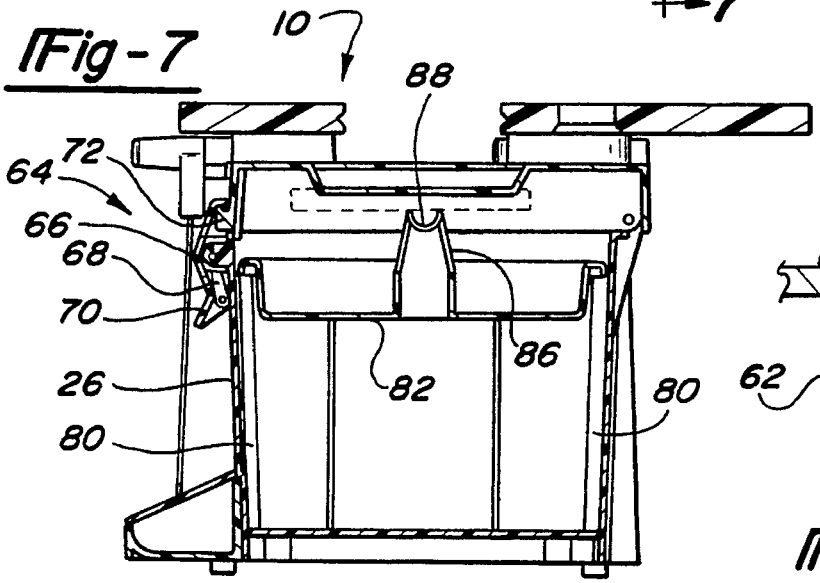
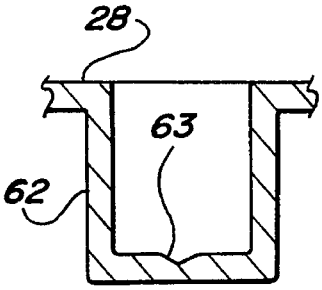
Fig-7A

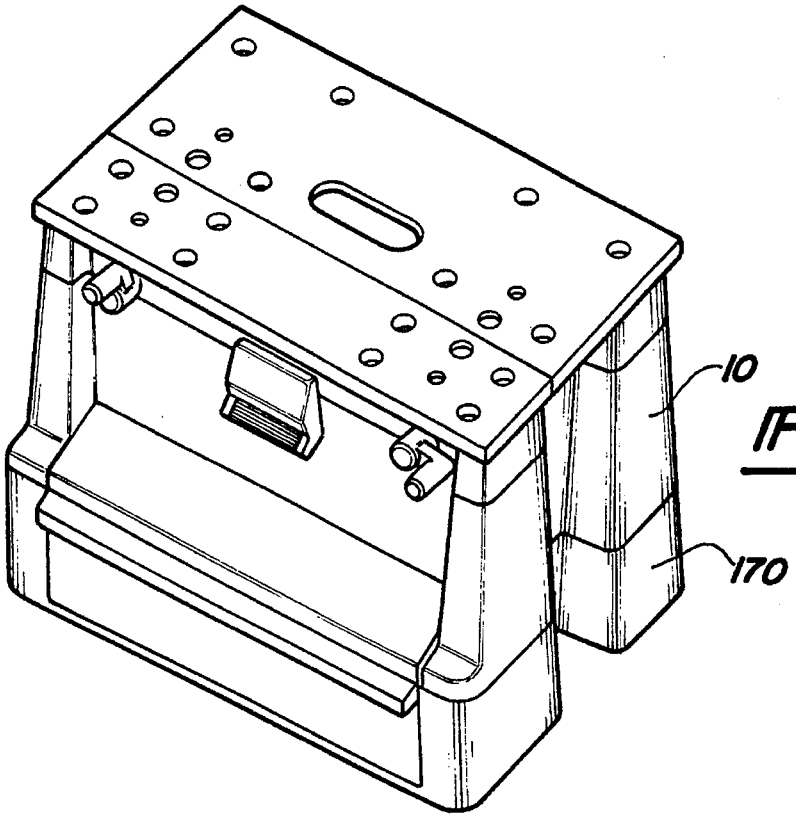
Fig-14
Fig-15
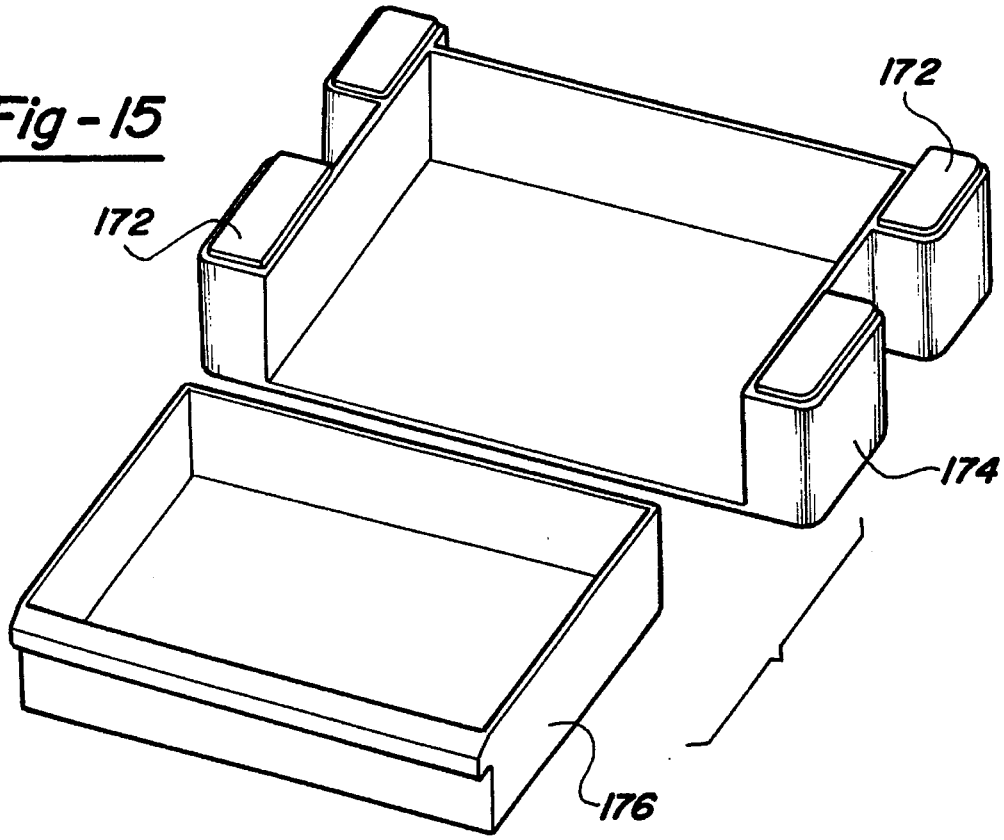

UTILITY BOX INCORPORATING AN INTEGRAL CLAMPING VISE

FIELD OF THE INVENTION

The present invention relates to portable utility boxes used for storing an/or carrying tools and the like to a remote job site. More particularly, the present invention relates to portable utility boxes used for storing and/or carrying tools and the like which include a clamping vise as an integral part of the cover of the utility box.

BACKGROUND OF THE INVENTION

Utility boxes for storing and/or carrying tools to a remote job site are well known in the art. These conventional utility boxes normally have a base which is formed into a container for storing the tools and a cover which mates with the base to limit the access to the storage area of the base. The cover is normally hingedly secured to the base at one side thereof and has some type of a latch located at the opposite side thereof for securing the cover to the base when the cover is in the closed position. Optionally, the cover can be secured to the base using a plurality of latches when it is desired to have the capability of totally separating the cover from the base.

In order to facilitate transporting conventional utility boxes from one job site to another, conventional utility boxes have been provided with various types of handles. The various designs of handles include the integrally formed types of handles and handles which are separate components which are secured to either the base or the cover of the utility box. Integrally formed handles include apertures which are formed into either the base or the cover which provide access for an individual's hand to grasp the utility box and/or handles formed into the edges or sides of either the base or the cover to allow an individual to carry the utility box. Another design of an integral handle is a handle which forms a part of an auxiliary tray within the tool box which is designed to extend through an aperture extending through the cover. The individual can grasp the tray handle which in turn serves as the utility box handle when the cover is secured to the base. Separate handles which are secured to the base and/or cover are normally rotatably secured to one of these members to allow the handle to fold down to an out of the way location when the handle is not in use. When these separate handles are secured to an upper surface of the cover, a corresponding recess can be formed into the cover to provide a flush surface for the cover when the handle is not in use. This flush surface then allows for various secondary uses of these conventional utility boxes.

Secondary uses for conventional utility boxes, in addition to storing and/or carrying tools, include the use of the utility box as a stool, a chair, a sawhorse and/or a worksurface. Normally when the utility box is being designed for one of these secondary uses, both the base and the cover are reinforced in order to support the additional loading on the utility box which will occur due to the specific secondary use.

While these conventional utility boxes have simplified the problems with storing and/or carrying tools to a remote job site and simplified some of the tasks which must be performed at the job site due to their secondary uses, when it becomes necessary to utilize a clamping vise at the remote job site, the individual is required to carry an additional portable vise to the particular job site. Carrying this additional piece of equipment is inconvenient for the individual, especially when carrying the utility box requires the individual to use both hands. This then requires that the individual stack the separate vise on top of the utility box or to make separate trips to the remote job site with the utility box and the portable vise.

Accordingly, what is needed is something that has escaped box designers for decades: a way to equip a portable utility box with a portable vise to simplify transporting both the utility box and the portable vise to a remote job site and a way to incorporate that vise into a worksurface on the box.

SUMMARY OF THE INVENTION

The present invention solves the problem with a utility box for storing and/or carrying tools to a remote job site which includes a clamping vise as an integral part of the cover of the tool box. Both the base and the cover are designed to provide the additional structure required to support the operation of the clamping vise. One of the jaws of the clamping vise includes an aperture extending through the jaw to act as a handle to facilitate moving and/or carrying the utility box from one job site to another. In addition, both of the jaws of the clamping vise cooperate with the cover and the base to form a pair of handles on the sides of the utility box to again facilitate moving and/or carrying the clamping vise from one job site to another. Other features of the utility box of the present invention include an exteriorly located pads tray, an integrally formed pair of clamping feet for securing the utility box to a separate structure and an auxiliary tray placed within the utility box for aiding in the organization of the items which are located within the utility box. The clamping vise in a preferred embodiment includes jaws which can be moved to angular positions relative to one another, similar to the worksurface of the famous WORKMATE® workcenter sold by the Assignee of the utility box of the present invention.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 5 is a side elevational view of the utility box of the present invention with the cover in the closed position;

FIG. 6 is a rear elevational view of the utility box of the present invention with the cover in the closed position;

FIG. 7 is a sectional view in the direction of arrow 7—7 shown in FIG. 6;

FIG. 7A is an enlarged sectional view of one of the recessed feed molded into the floor of the utility box of the present invention;

FIG. 14 illustrates the utility box of the present invention being supported by a drawer support; and FIG. 15 is a perspective view of the drawer support shown in FIG. 14 with the drawer removed.

DESCRIPTION OF THE PREFERRED EMBODIMENTS

Figure 1:
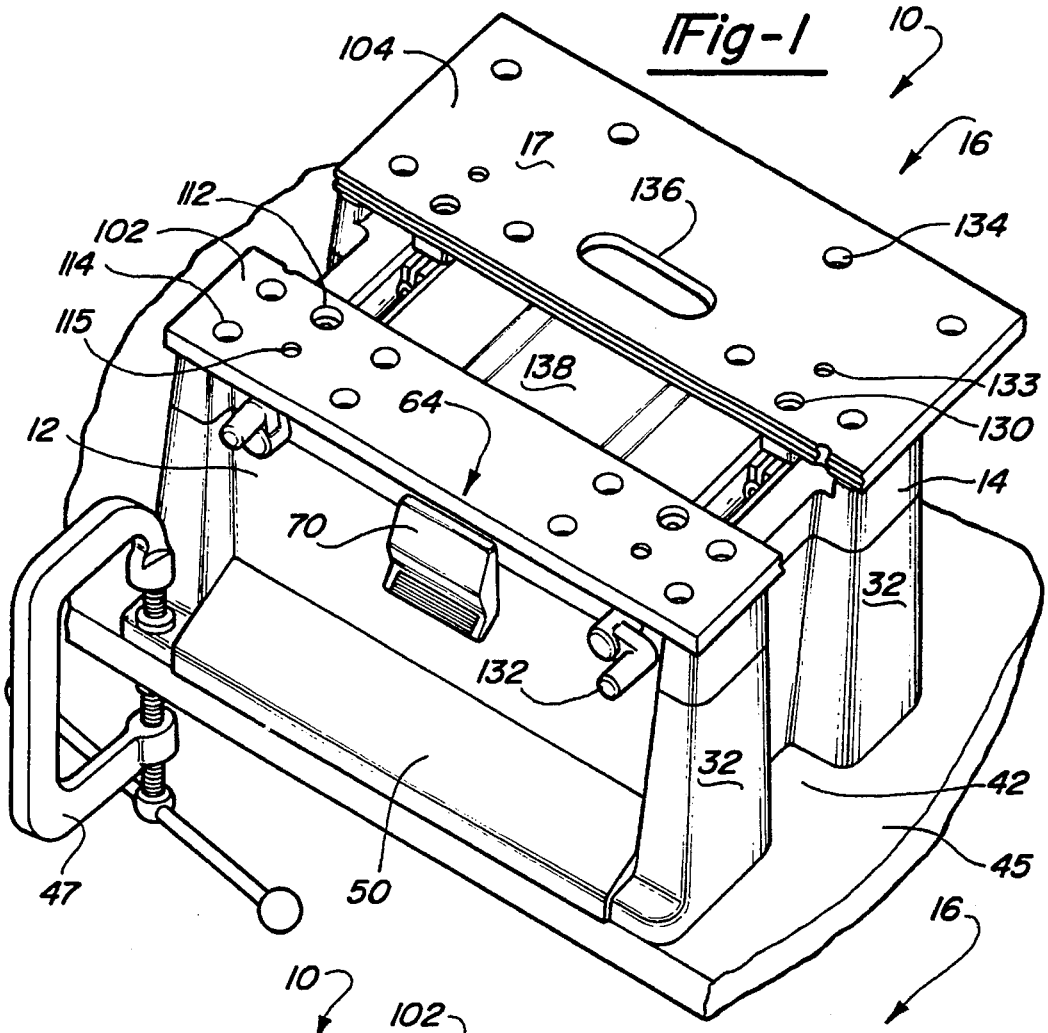
FIG. 1 is a perspective view of the utility box of the present invention with the cover located in the closed condition and with the clamping jaws spaced apart.
Figure 4:
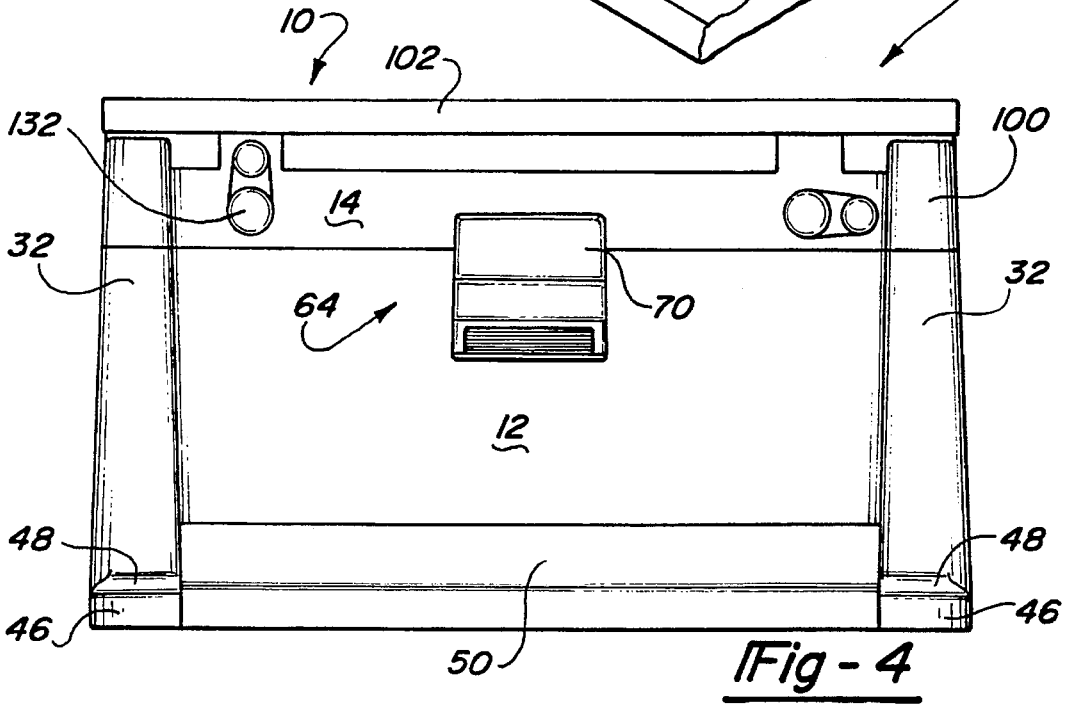
FIG. 4 is a front elevational view of the utility box of the present invention with the cover in the closed position.

Referring now to the drawings in which like reference numerals designate like or corresponding parts throughout the several views, there is shown in FIGS. 1 through 11 a utility box in accordance with the present invention which is designated generally by the reference numeral 10. Utility box 10 includes a base 12 and a cover 14, which further includes an integral clamping vise 16 and a worksurface 17.

Figure 3:
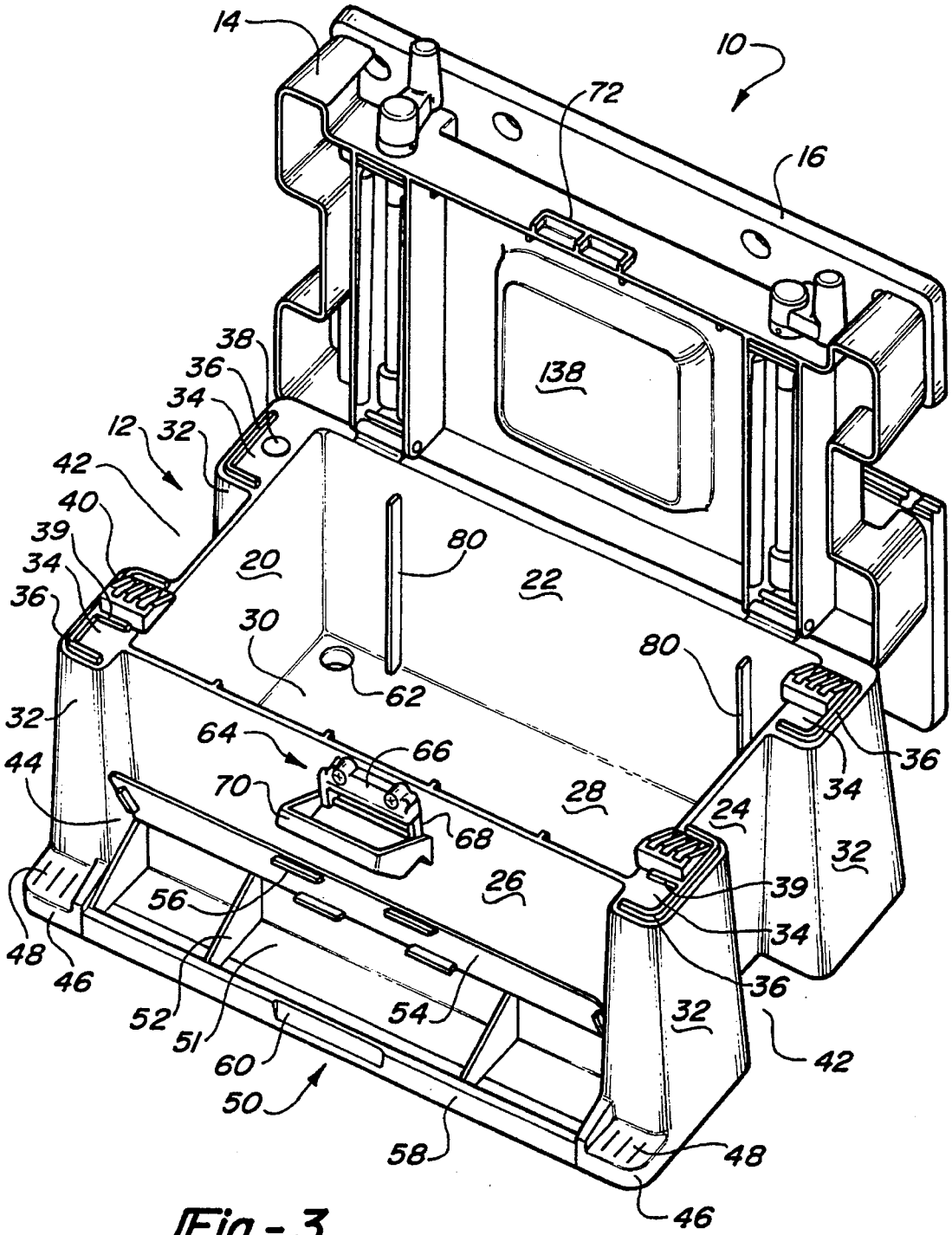
FIG. 3 is a perspective view of the utility box of the present invention with the cover in the open position and the auxiliary tray removed.
Figure 8:
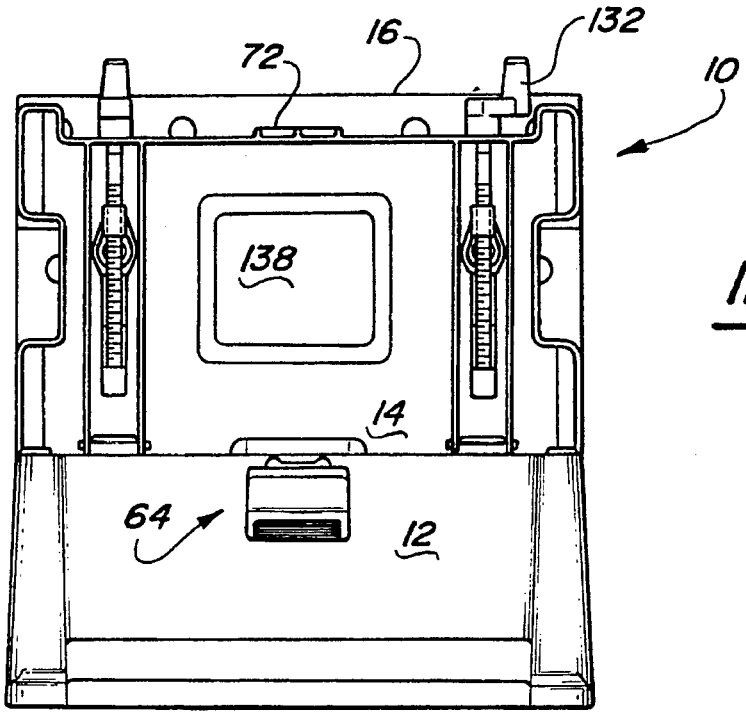
FIG. 8 is a front elevational view of the utility box of the present invention with the cover in the open position and the auxiliary tray installed.
Figure 9:
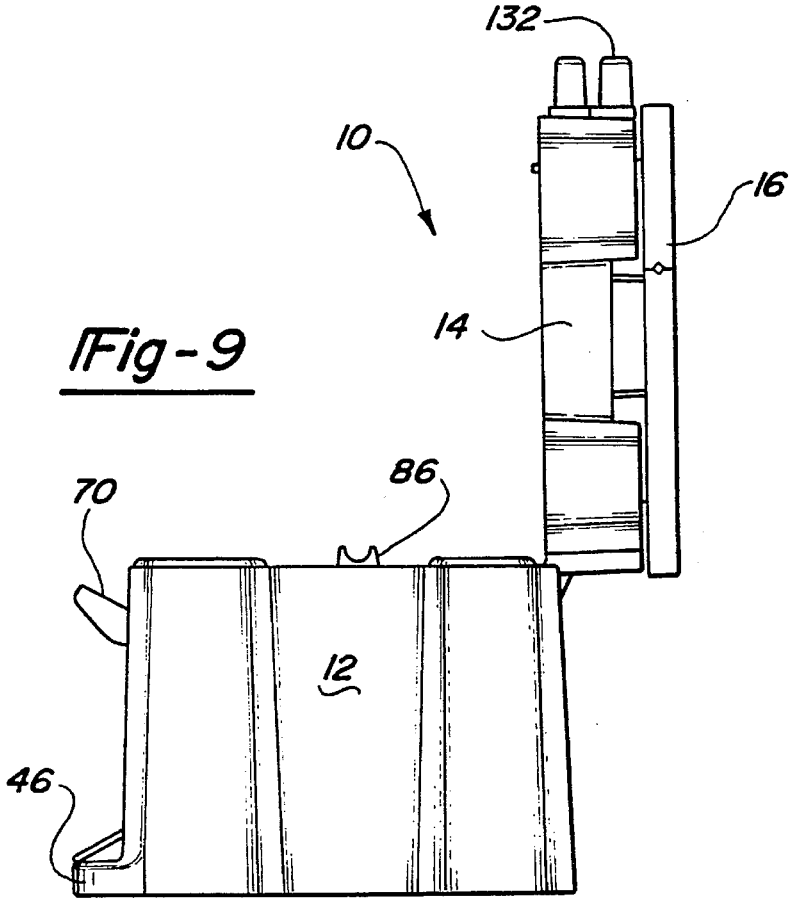
FIG. 9 is a side elevational view of the utility box of the present invention with the cover in the open position and the auxiliary tray installed.

Base 12, as shown in FIG. 3, is a generally rectangular box structure having a first side wall 20, a rear wall 22, a second side wall 24, a front wall 26 and a bottom panel 28 which define a chamber 30, within which various tools or the like (not shown) can be stored. Each corner of base 12 is provided with a pedestal or column 32, which extends out from base 12 to provide support for utility box 10. Each pedestal 32 has a generally rectangular cross section which gradually reduces in size as the section moves upwardly from the bottom to the top portion of the pedestal. The bottom of each pedestal 32 is open while the top of each pedestal is closed by an upper wall 34 (FIG. 3). Extending upward from each upper wall 34 is a positioning rib 36 which is designed to mate with cover 14 to align and lock cover 14 to base 12 when cover 14 is closed. Each upper wall 34 further defines an aperture 38 which is designed to do two things: to accept a clamping peg 40 for providing storage for clamping pegs 40 when they are not in use with clamping vise 16, and to accept the mold core pins. During the molding of base 12, the mold core used to form the interior of each pedestal 32 exhibits a tendency to deflect causing a non-uniform wall thickness for pedestals 32. In order to eliminate any deflecting of the mold core, a mold pin (not shown) was added to the top of each mold core such that when the mold was closed, these mold pins would mate with another section of the mold and properly position the mold core for pedestals 32. These mold pins thus extended through the molded base 10 to produce apertures 38. The mold pins are sized to produce an aperture 38 which securely holds clamping pegs 40 during shipping of utility box 10 and when clamping pegs 40 are not in use. The two front pedestals 32 include an intermediate section 39 of rib 36 which insures that pegs 40 inserted into apertures 38 of the front pedestals 32 are orientated correctly to allow the necessary clearance for closing cover 16. This feature is not included on the two rear pedestals 32 due to the fact that sufficient clearance is available at the rear pedestals 32 to allow for any orientation of pegs 40.

The pair of pedestals 32 associated with side wall 20 and the pair of pedestals 32 associated with the opposite side wall 24 each define a first recessed area or space 42 which serves as a vertical clamping space co-acting with clamping vise 16 of cover 14, as will be described later herein. In addition, each recessed area 42 cooperates with clamping vise 16 of cover 14 to form a pair of handles on opposite side walls 20 and 24 of base 12 as will also be described later herein.

The pair of pedestals 32 associated with front wall 26 of base 12 extend outwardly from front wall 26 to form a second recessed area or space 44. The base of each pedestal 32 associated with front wall 26 includes a clamping foot 46 which extends outwardly in a direction away from front wall 26. Each clamping foot 46 includes a clamping pad 48 which is designed to accept the clamping load applied, for example, by a C-clamp 47, as shown in FIG. 1, or by another type of conventional clamp. Thus, by positioning utility box 10 in an appropriate position on a relatively stationary surface 45, utility box 10 may then be secured to the surface using one of these conventional clamps. Clamping utility box 10 to a relatively stationary surface provides additional support when using integral clamping vise 16, as will be described later herein. When using utility box 10 without clamping it to a relatively stationary surface, a plurality of anti-skid feet 49 secured to the bottom of box 10 prohibits movement of box 10 when using integral vise 16.

Figure 10:
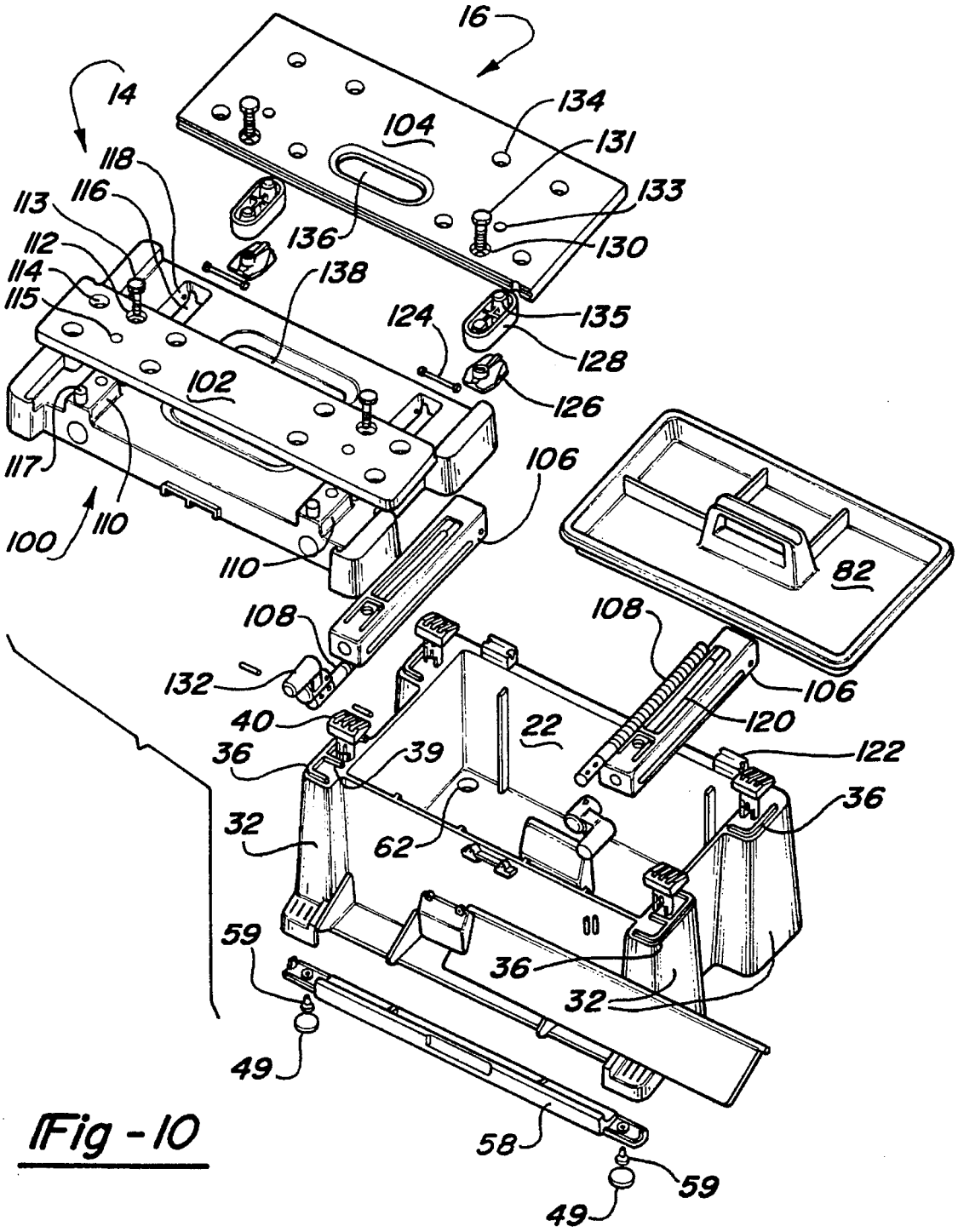
FIG. 10 is a exploded perspective view of the utility box of the present invention.

A parts tray 50 is located between the two front pedestals 32, and within second recessed area 44. Parts tray 50 includes a plurality of dividers 52 which separate parts tray 50 into multiple compartments 51. Parts tray 50 also includes a transparent cover 54 which is pivotably secured between the two front pedestals 32. By locating parts tray 50 at the lower portion of recessed area 44, cover 54 is accessible from the exterior of utility box 10, whether cover 14 is in its open or its closed position. A pair of retention tabs 56 interlace with a pair of apertures (not shown) in a front wall 58 of parts tray 50 to retain cover 54 into a closed position. When closing cover 54, each retention tab 56 deflects slightly in order to snap over a lip (not shown) and seat into a respective aperture to retain cover 54 in its closed position. Front wall 58 of parts tray 50 is preferably a separate member which is secured to clamping feet 46 of base 12 by a pair of fasteners 59 as shown in FIG. 10. Once front wall 58 is secured to clamping feet 40 by fasteners 59, anti-skid feet 49 are secured to the bottom of front wall 58 such that feet 49 cover fasteners 59 and extend slightly below the bottom of utility box 10. A localized recessed area 60 in front wall 58 of parts tray 50 provides finger access to the bottom of cover 54 to simplify opening of the cover.

Referring now to FIGS. 3, 7 and 7A, bottom panel 28 of box 10 provides a floor for chamber 30 and is provided with a plurality of recessed feet 62 with one recessed foot 62 being located at each corner of base 12. Each recessed foot 62 is provided as a closed indentation into bottom panel 28 which is designed to be easily opened by drilling or other means to provide clearance for a screw or bolt when it is desired to mount utility box 10 to a stationary surface. The bottom wall of each recessed foot is dimpled with a 120° angular conical recess 63 to allow accurate positioning of a drill bit when a screw hole is required to secure utility box 10 to a worksurface or a support. Thus, utility box 10 can be temporarily mounted to a supporting surface by using a plurality of clamps and clamping feet 46, or utility box 10 can be more permanently mounted to the supporting surface by utilizing recessed feet 62 along with a plurality of screws or bolts. Either method will provide additional support to utility box 10 when it is required when using clamping vise 16.

An over-center latch 64, as best shown in FIG. 7, includes a base 66 which is mounted to front wall 26, an intermediate link 68 which is pivotably secured to base 66 and a locking member 70 which is pivotably secured to intermediate link 68. Locking member 70 mates with a locking tab 72 which is secured to cover 14 and through the over-center action of latch 64, retains cover 14 in a closed and locked condition. Locking member 70 is a single piece member which is designed to form a cover for base 66, intermediate link 68 and locking tab 72 when locking member 70 is located in its locked position. This provides a clean and aesthetically pleasing look to utility box 10.

Figure 2:
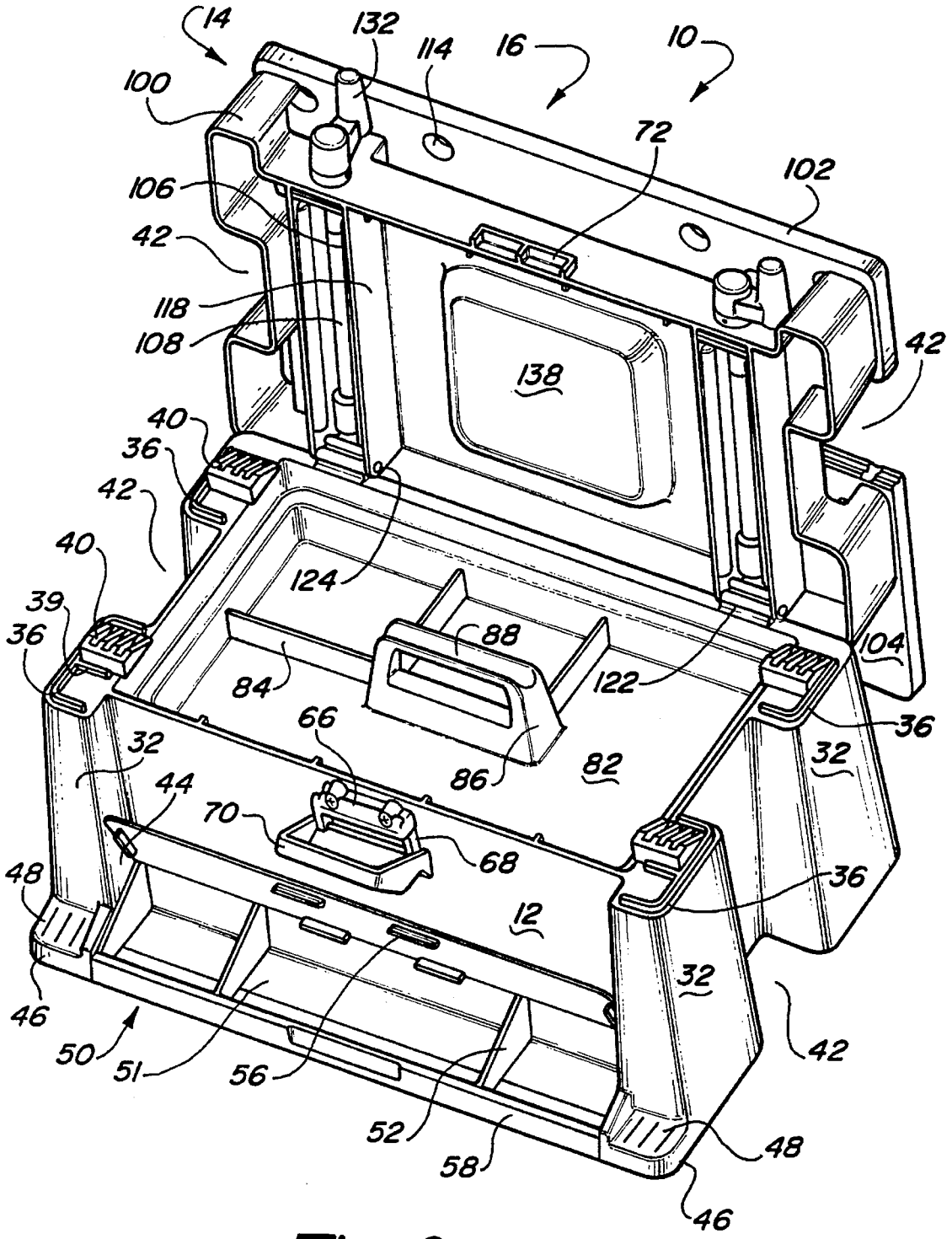
FIG. 2 is a perspective view of the utility box of the present invention with the cover in the open position and the auxiliary tray installed.

Referring again to FIG. 3, rear wall 22 and front wall 26 are each provided with a plurality of support ribs 80 which extend from walls 22 and 26 into chamber 30. Support ribs 80 extend upward from bottom panel 28 towards the top of walls 22 and 26 to form supporting structure for an auxiliary parts tray 82. Parts tray 82, shown in FIG. 2, is a generally rectangular tray which nests within chamber 30 on support ribs 80. Parts tray 82 includes a plurality of dividers 84 which form multiple compartments within parts tray 82. A unitary handle 86 extends upward from tray 82 and is provided with a curved upper wall 88 which is utilized to remove tray 82 from chamber 30 of utility box 10. The height of integral handle 86 is designed such that it will be contained in chamber 30 and covered by cover 14 when cover 14 is placed in its closed and latched position.

Referring now to FIG. 10, cover 14 includes a base 100 and clamping vise 16. Clamping vise 16 is comprised of a stationary jaw 102, a movable jaw 104, a pair of frames 106 and a pair of clamping screws 108. Stationary jaw 102 and movable jaw 104 are preferably made of wood although other materials including, but not limited to, plastic can be utilized if desired. Jaws 102 and 104 cooperate to form worksurface 17 when movable jaw 104 is in both its open and its closed position.

Base 100 has a configuration which simultaneously mates with both base 12 and the plurality of pedestals 32 as best shown in FIG. 1. Base 100 extends around the outer periphery of base 12 and pedestals 32 and mates with positioning ribs 36 which both position and locate base 100 with respect to base 12 and pedestals 32 when box 10 is closed. Mating base 100 with base 12 and pedestals 32 thus extends first recessed areas 42 and second recessed area 44 upward through base 100 of cover 14. The front portion of base 100 defines a pair of upstanding pedestals 110 which support stationary jaw 102 at a level where it mates with movable jaw 104 to form clamping vise 16. Stationary jaw 102 is provided with a plurality of mounting holes 112 for securing stationary jaw 102 to base 100 via fasteners 113. An additional set of through holes 115 are provided in jaw 102 with each hole 115 mating with a respective guide pin 117 to position and secure stationary jaw 102 to base 100. Stationary jaw 102 further includes a plurality of though apertures 114 which extend through stationary jaw 102 at various locations. Apertures 114 provide various locations for inserting clamping pegs 40 to improve the versatility of clamping vise 16, as is done in the WORKMATE® workcenters.

Adjacent to and extending rearwardly from pedestals 110 are a pair of rectangular apertures 116 which provide access for movable jaw 104 to mate with clamping screws 108. A pair of downwardly-extending walls 118 extend below each corresponding rectangular aperture 116 and pedestal 110 to provide for the mounting of a respective frame 106. Each frame 106 is mounted between a respective pair of walls 118 extending between the front and rear of base 100. A rectangular aperture 120 extending through the upper wall of each frame 106 mates with a respective rectangular aperture 116 in base 100 to allow access to screws 108 by movable jaw 104, similar to U.S. Pat. No. 3,615,087, the disclosure of which is hereby incorporated herein by reference.

Each screw 108 extends through the front wall of base 100, through the front wall of a respective frame 106 and is rotatably supported by the rear wall of the respective frame 106. Both pairs of walls 118 of base 100 and each frame 106 are rotatably secured to a respective hinge base 122, which is an integral part of rear wall 22, by a hinge pin 124. Thus, cover 14 is hingedly secured to base 12 through hinge pin 124. Each frame 106 is thus secured to base 100 by virtue of hinge pin 124 extending through walls 118 and frames 106 and by screws 108 extending through frames 106 and the front wall of base 100.

Each screw 108 threadably engages a nut 126 which is secured to a respective shuttle 128 which is in turn secured to movable jaw 104. The combination of nut 126 and shuttle 128 thus secure movable jaw 104 to screw 108 through apertures 116 and 120. Movable jaw 104 is provided with a plurality of mounting holes 130 for mounting movable jaw 104 to shuttle 128 and nut 126 via fasteners 131. An additional set of through holes 133 are provided in jaw 104 with each hole 133 mating with a respective guide pin 135 to position and secure movable jaw 104 to shuttle 128. The attachment between nut 126 and shuttle 128 allows for a limited amount of rotation between the two components to allow for different positioning of the two shuttles 128 with respect to their respective screw 108. This difference in positioning of the two shuttles 128 permits angularity in movable jaw 104 with respect to stationary jaw 102 thus further increasing the versatility of clamping vise 16.

The interconnection of movable jaw 104 with screws 108 through shuttles 128 and nuts 126 allows for the independent axial movement of shuttles 128 and nuts 126 within apertures 116 and 120 when screw 108 is rotated. A handle 132 is fixedly secured to the outside end of each screw 108 to aid in rotating screws 108. Thus, movable jaw 104 can be moved towards or away from stationary jaw 102 by the rotation of handles 132 to effect the tightening and loosening of clamping vise 16.

In addition to the plurality of holes 130 in movable jaw 104, movable jaw 104 defines a plurality of apertures 134 which extend through movable jaw 104 at various locations. Apertures 134, similar to apertures 114, provide various locations for inserting clamping pegs 40 to further improve the versatility of clamping vise 16. A generally rectangular aperture 136 also extends through movable jaw 104 to provide a handle for moving and/or carrying utility box 10. A generally rectangular recess 138 is formed into base 100 to provide clearance for an individual to extend his or her hand through aperture 136. If desired, recess 138 may also be used as an auxiliary storage dish. In order to provide a comfortable surface for an individual to grasp the walls of aperture 136 can be chamfered or rounded, as shown in FIG. 10.

During the use of clamping vise 16, vertical recesses 42 located on the opposite sides of base 12 allow for the vertical-clamping of various articles due to the fact that the article is allowed to extend into recess 42 between adjacent pedestals 32. In addition, when movable jaw 104 is positioned adjacent to fixed jaw 102, vertical recesses 42 form a pair of carrying handles located on opposite sides of base 12 with the weight of utility box 10 being supported by jaws 102 and 104.

Figure 11A:
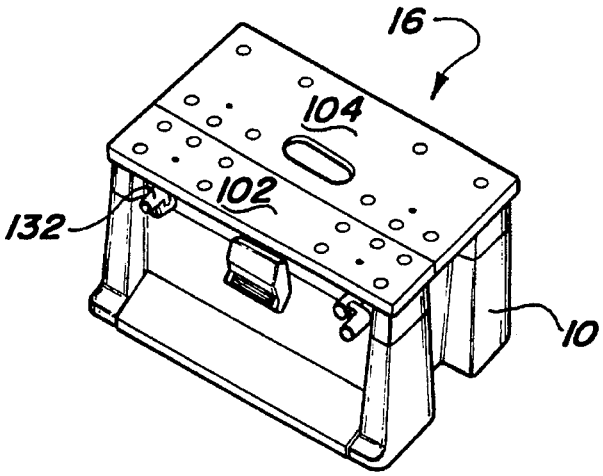
FIGS. 11A–11D illustrate the unique clamping capabilities of the vise on the cover of the utility box of the present invention.
Figure 11B:
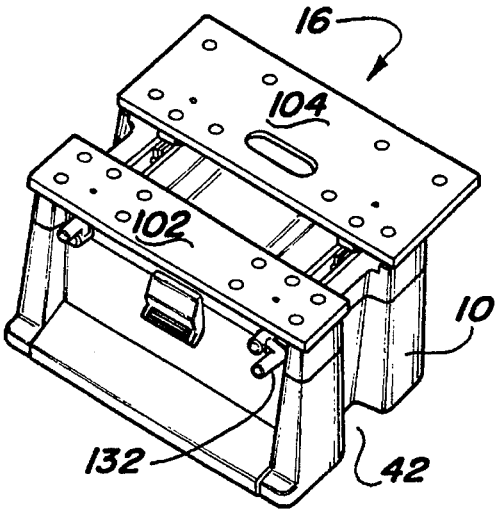
Figure 11C:
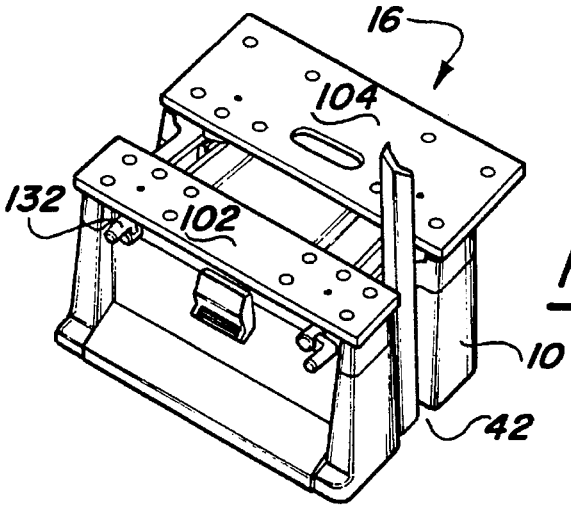
Figure 11D:
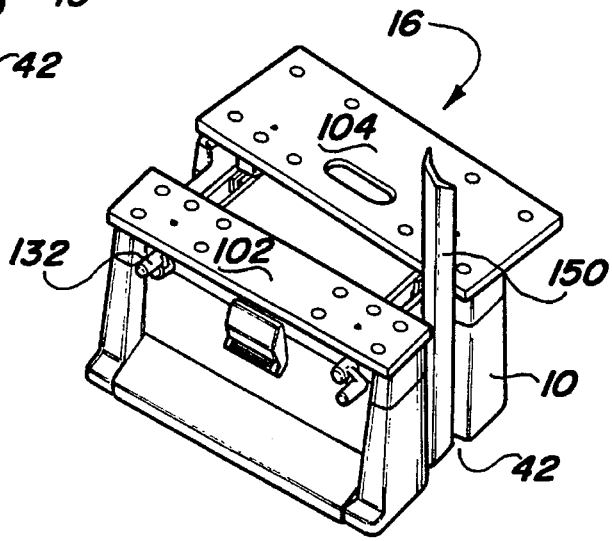

FIGS. 11A through 11D illustrate the unique clamping capabilities of vise 16 due to the fact that movable jaw 104 is capable of moving parallel with stationary jaw 102 as well as moving to an angular position with respect to stationary jaw 102. FIG. 11A illustrates utility box 10 with jaws 102 and 104 of vise 16 located in their closed position. FIG. 11B illustrates utility box 10 with movable jaw 104 opened to a position where it is generally parallel to stationary jaw 102 and ready to accept an article to be clamped. Movable jaw 104 was moved into its open position by the equal rotation of both handles 132. FIG. 11C illustrates the placement into vise 16 of an article 150 which is to be clamped. Article 150 is positioned vertically with respect to utility box 10 and vise 16. This vertical placement of article 150 is permitted by first recessed areas 42 extending through cover 14 and base 12 which allows article 150 to extend below vise 16 a length which is equal to the height of utility box 10. FIG. 11D illustrates the clamping of article 150 by vise 16. The unique capability of vise 16 to have movable jaw 104 move angularly with respect to stationary jaw 102 allows vise 16 to clamp irregular shaped objects as shown in FIG. 11D. The angular relationship of movable jaw 104 with respect to stationary jaw 102 is accomplished by rotating each handle 132 a different amount thus angling movable jaw 104.

Figure 12:
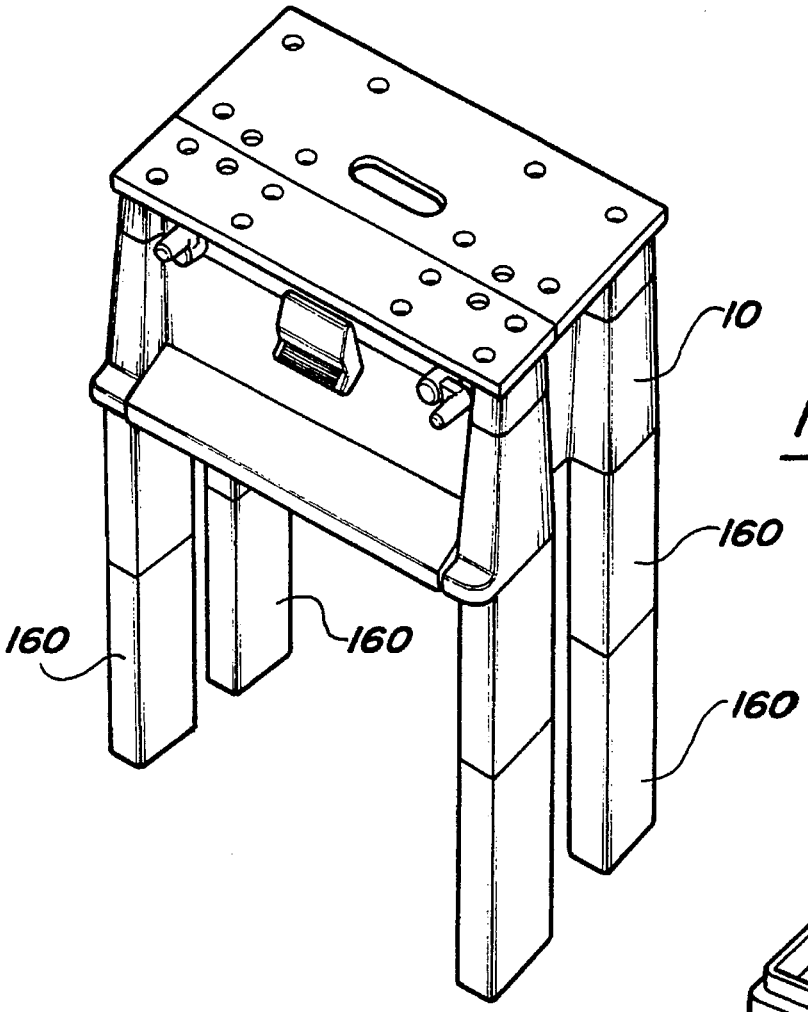
FIG. 12 illustrates the utility of the present invention being supported by a plurality of support feet.
Figure 13:
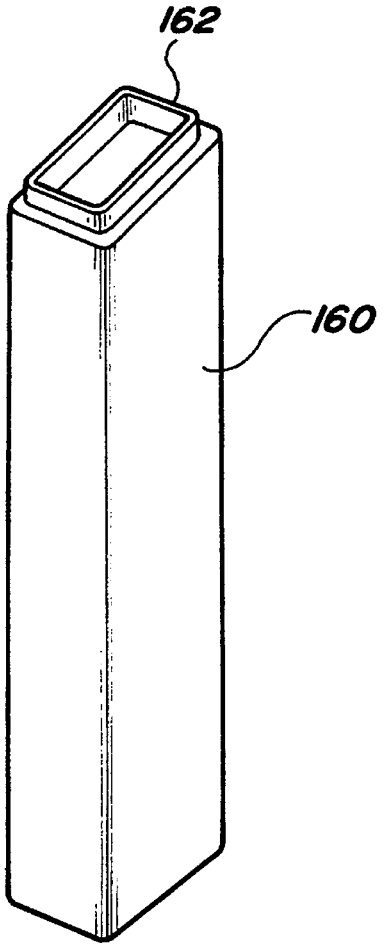
FIG. 13 is a perspective view of one of the support feet shown in FIG. 12.

FIGS. 12 and 13 illustrate another embodiment of the present invention whereby utility box 10 is supported at a predetermined height by a plurality of support legs 160. Each support leg 160 is shaped to mate with the open end of a respective pedestal 32. A locating rib 162 extends around the upper surface of each support leg 160 to both locate and secure support leg 160 to pedestal 32. The lower section of support leg 160 is shaped similar to the lower section of pedestal 32 such that it is possible to stack two or more support legs 160 in order to increase the height of utility box 10 if desired. When stacking support legs 160, locating rib 162 of the lower support leg 160 will locate and secure the lower support leg 160 to the upper support leg 160 in a similar manner to the locating and securing of support leg 160 into pedestal 32.

FIGS. 14 and 15 illustrate yet another embodiment of the present invention whereby utility box 10 further includes a pair of drawer support sections 170. Drawer support 170 is shaped to mate with the bottom of base 12 and pedestals 32 and includes four locating platforms 172, with each platform 172 being shaped to mate with the open end of a respective pedestal 32. Locating platforms 172 both locate and secure drawer support 170 to utility box 10. Drawer support 170 comprises a support member 174 and a drawer 176 which is slidingly received within support member 174. The lower section of drawer support 170 is shaped similar to the bottom of base 12 and pedestals 32 such that it is possible to stack two or more drawer supports 170 in order to increase the height of utility box 10 if desire. When stacking drawer supports 170, locating platforms 172 of the lower drawer support 170 will locate and secure the lower drawer support 170 to the upper drawer support 170 in a similar manner to the locating and securing of drawer support 170 into utility box 10.

While the above detailed description describes the preferred embodiment of the present invention, it should be understood that the present invention is susceptible to modification, variation and alteration without deviating from the scope and fair meaning of the subjoined claims.

What is claimed is:

1. A utility box comprising:

a base defining an open chamber for holding at least one article; and a clamping vise secured to said base, said clamping vise forming a cover for closing said open chamber.

2. The utility box of claim 1, wherein said clamping vise is hingedly secured to said base.

3. The utility box of claim 1, further comprising at least one latch for securing said clamping vise to said base.

4. The utility box of claim 3, wherein said at least one latch is an over-center type of latch.

5. The utility box of claim 1, wherein said base includes at least one clamping foot.

6. The utility box of claim 1, further comprising a parts tray secured to an exterior wall of said base.

7. The utility box of claim 6, wherein said parts tray is accessible when said clamping vise closes said open chamber.

8. The utility box of claim 6, wherein said parts tray is integral with said base.

9. The utility box of claim 6, wherein said parts tray includes at least one divider disposed within said tray for separating said parts tray into multiple compartments.

10. The utility box of claim 6, wherein said parts tray includes a cover hingedly secured to said base.

11. The utility box of claim 1, further comprising an auxiliary removable tray disposed within said chamber.

12. The utility box of claim 1, wherein said base defines a plurality of pedestals.

13. The utility box of claim 1, wherein said clamping vise comprises a first jaw secured to said base and a second jaw connected to said first jaw, said second jaw being movable with respect to said first jaw.

14. The utility box of claim 13, wherein said clamping vise includes at least one screw rotatably secured to said first jaw, said at least one screw being operable to move said second jaw with respect to said first jaw.

15. The utility box according to claim 13, wherein said jaws define a worksurface.

16. The utility box of claim 13, wherein one of said jaws defines an aperture extending through said jaw to act as a handle for said utility box.

17. The utility box of claim 16, wherein said aperture is not in communication with said open chamber.

18. The utility box of claim 1, wherein said clamping vise comprises:

a fixed jaw secured to said base, said fixed jaw defining a fixed clamping face;

a movable jaw secured to said fixed jaw, said movable jaw defining a movable clamping face; and clamping means operatively coupled between said fixed jaw and said movable jaw for moving said movable jaw relative to said fixed jaw to securely hold a workpiece between said clamping faces, said clamping means including means for moving said movable jaw such that said movable clamping face is moved into a substantially non-parallel relationship to said fixed clamping face to facilitate the holding of said workpiece.

19. The utility box of claim 18, wherein each of said jaws has a plurality of apertures formed through an upper surface thereof.

20. The utility box of claim 18, wherein said clamping means comprises a pair of independently-operable screw threaded devices and means for coupling each of said devices to said movable jaw for permitting angular movement of said movable jaw relative to each screw threaded device.

21. The utility box according to claim 18, wherein said jaws define a worksurface.

22. The utility box of claim 18, wherein one of said jaws defines an aperture extending through said jaw to act as a handle for said utility box.

23. The utility box of claim 22, wherein said aperture is not in communication with said open chamber.

24. The utility box according to claim 1, further comprising at least one support leg connected to said base.

25. The utility box according to claim 1, further comprising a plurality of support legs connected to said base.

26. The utility box according to claim 1, further comprising a drawer support connected to said base.

27. A utility box comprising:

a base defining an open chamber for holding at least one article;

a fixed jaw secured to said base; and a movable jaw connected to said fixed jaw, said movable jaw being movable with respect to said fixed jaw., said fixed jaw and said movable jaw forming a cover for closing said open chamber.

28. The utility box of claim 27, wherein said clamping vise includes at least one screw rotatably secured to said fixed jaw, said at least one screw being operable to move said movable jaw with respect to said fixed jaw.

29. The utility box of claim 27, wherein said fixed jaw is hingedly secured to said base.

30. The utility box of claim 27, further comprising at least one latch for securing said fixed jaw and said movable jaw to said base.

31. The utility box of claim 30, wherein said at least one latch is an over-center type of latch.

32. The utility box of claim 27, wherein said base includes at least one clamping foot.

33. The utility box of claim 27, further comprising a parts tray secured to an exterior wall of said base.

34. The utility box of claim 33, wherein said parts tray is accessible when said fixed jaw and movable jaw are secured to said base.

35. The utility box of claim 33, wherein said parts tray is integral with said base.

36. The utility box of claim 33, wherein said parts tray includes at least one divider disposed within said tray for separating said parts tray into multiple compartments.

37. The utility box of claim 33, wherein said parts tray includes a cover hingedly secured to said base.

38. The utility box of claim 27, further comprising an auxiliary tray disposed within said chamber.

39. The utility box of claim 27, wherein said base defines a plurality of pedestals.

40. The utility box according to claim 27, wherein said jaws define a worksurface.

41. The utility box of claim 27, wherein one of said jaws defines an aperture extending through said jaw to act as a handle for said utility box.

42. The utility box of claim 41, wherein said aperture is not in communication with said open chamber.

43. The utility box of claim 27 wherein, said fixed jaw defines a fixed clamping face and said movable jaw defines a movable clamping face, said utility box further comprising:

clamping means operatively coupled between said fixed jaw and said movable jaw for moving said movable jaw relative to said fixed jaw to securely hold a workpiece between said clamping faces, said clamping means including means for moving said movable jaw such that said movable clamping face is moved into a substantially non-parallel relationship to said fixed clamping face to facilitate the holding of said workpiece.

44. The utility box of claim 43, wherein each of said jaws has a plurality of apertures formed through the upper surface thereof.

45. The utility box of claim 43, wherein said clamping means comprises a pair of independently-operable screw threaded devices and means for coupling each of said devices to said movable jaw for permitting angular movement of said movable jaw relative to each screw threaded device.

46. The utility box according to claim 27, further comprising at least one support leg connected to said base.

47. The utility box according to claim 27, further comprising a plurality of support legs connected to said base.

48. The utility box according to claim 27, further comprising a drawer support connected to said base.

49. A utility box comprising:

a generally rectangular base defining an open chamber for holding at least one article;

a cover secured to said base; and a pedestal disposed at each corner of said generally rectangular base, each adjacent pair of pedestals forming a first recessed area of said base between each said adjacent pair of pedestals, each of said first recessed areas extending the entire height of said base.

50. The utility box of claim 49 wherein each of said pedestals extend into said cover to form a second recessed area between each of said adjacent pair of pedestals, said second recessed areas extending over the entire height of said cover.

51. The utility box of claim 49, further comprising a clamping vise connected to said cover.

52. The utility box of claim 51, wherein said clamping vise comprises a first jaw fixedly secured to said cover and a second jaw secured to said cover, said second jaw being movable with respect to said first jaw.

53. The utility box of claim 52, wherein said clamping vise includes at least one screw rotatably secured to said cover, said at least one screw being operable to move said second jaw with respect to said first jaw.

54. The utility box according to claim 52, wherein said jaws define a worksurface.

55. The utility box of claim 52, wherein one of said jaws defines an aperture extending through said jaw to act as a handle for said utility box.

56. The utility box of claim 55, wherein said cover defines a recess in alignment with said rectangular aperture.

57. The utility box of claim 51, wherein said clamping vise comprises:

a fixed jaw secured to said cover, said fixed jaw defining a fixed clamping face;

a movable jaw secured to said cover, said movable jaw defining a movable clamping face; and clamping means operatively coupled between said fixed jaw and said movable jaw for moving said movable jaw relative to said fixed jaw to securely hold a workpiece between said clamping faces, said clamping means including means for moving said movable jaw such that said movable clamping face is moved into a substantially non-parallel relationship to said fixed clamping face to facilitate the holding of said workpiece.

58. The utility box of claim 57, wherein each of said jaws has a plurality of apertures formed through the upper surface thereof.

59. The utility box of claim 57, wherein said clamping means comprises a pair of independently-operable screw threaded devices and means for coupling each of said devices to said movable jaw for permitting angular movement of said movable jaw relative to each screw threaded device.

60. The utility box according to claim 57, wherein said jaws define a worksurface.

61. The utility box of claim 57, wherein one of said jaws defines an aperture extending through said jaw to act as a handle for said utility box.

62. The utility box of claim 61, wherein said cover defines a recess in alignment with said rectangular aperture.

63. The utility box of claim 49, wherein said cover is hingedly secured to said base.

64. The utility box of claim 49, further comprising at least one latch for securing said cover to said base.

65. The utility box of claim 64, wherein said at least one latch is an over-center type of latch.

66. The utility box of claim 49, wherein said base includes at least one clamping foot.

67. The utility box of claim 49 further comprising a parts tray secured to an exterior wall of said base and disposed within one of said first recessed areas.

68. The utility box of claim 67, wherein said parts tray is accessible when said cover is closed.

69. The utility box of claim 67, wherein said parts tray is integral with said base.

70. The utility box of claim 67, wherein said parts tray includes at least one divider disposed within said tray for separating said parts tray into multiple compartments.

71. The utility box of claim 67, wherein said parts tray includes a cover hingedly secured to said base.

72. The utility box of claim 49, further comprising an auxiliary removable tray disposed within said chamber.

73. The utility box according to claim 49, further comprising at least one support leg connected to said base.

74. The utility box according to claim 49, further comprising a plurality of support legs connected to said base.

75. The utility box according to claim 49, further comprising a drawer support connected to said base.

76. A utility box comprising:

a generally rectangular base defining an open chamber for holding at least one article;

a clamping vise secured to said base, said clamping vise forming a cover for closing said open chamber; and at least one clamping foot secured to said base, said at least one clamping foot adapted to co-act with a clamp for securing said utility box to a working surface.

77. The utility box of claim 76, wherein said at least one clamping foot is integral with said base.

78. The utility box of claim 76, wherein said clamping vise is hingedly secured to said base.

79. The utility box of claim 76, further comprising at least one latch for securing said clamping vise to said base.

80. The utility box of claim 79, wherein said at least one latch is an over-center type of latch.

81. The utility box of claim 76, further comprising a parts tray secured to an exterior wall of said base.

82. The utility box of claim 81, wherein said parts tray is accessible when said clamping vise closes said open chamber.

83. The utility box of claim 81, wherein said parts tray is integral with said base.

84. The utility box of claim 81, wherein said parts tray includes at least one divider disposed within said tray for separating said parts tray into multiple compartments.

85. The utility box of claim 81, wherein said parts tray includes a cover hingedly secured to said base.

86. The utility box of claim 76, further comprising an auxiliary removable tray disposed within said chamber.

87. The utility box of claim 76, wherein said base defines a plurality of pedestals.

88. The utility box of claim 76, wherein said clamping vise comprises a first jaw fixedly secured to said base and a second jaw secured to said first jaw, said second jaw being movable with respect to said first jaw.

89. The utility box of claim 88, wherein said clamping vise includes at least one screw rotatably secured to said first jaw, said at least one screw being operable to move said second jaw with respect to said first jaw.

90. The utility box according to claim 88, wherein said jaws define a worksurface.

91. The utility box of claim 88, wherein one of said jaws defines an aperture extending through said jaw to act as a handle for said utility box.

92. The utility box of claim 91, wherein said aperture is not is communication with said open chamber.

93. The utility box of claim 76, wherein said clamping vise comprises:

a fixed jaw secured to said base, said fixed jaw defining a fixed clamping face;

a movable jaw secured to said fixed jaw, said movable jaw defining a movable clamping face; and clamping means operatively coupled between said fixed jaw and said movable jaw for moving said movable jaw relative to said fixed jaw to securely hold a workpiece between said clamping faces, said clamping means including means for moving said movable jaw such that said movable clamping face is moved into a substantially non-parallel relationship to said fixed clamping face to facilitate the holding of said workpiece.

94. The utility box of claim 93, wherein each of said jaws has a plurality of apertures formed through the upper surface thereof.

95. The utility box of claim 93, wherein said clamping means comprises a pair of independently-operable screw threaded devices and means for coupling each of said devices to said movable jaw for permitting angular movement of said movable jaw relative to each screw threaded device.

96. The utility box according to claim 93, wherein said jaws define a worksurface.

97. The utility box of claim 93, wherein one of said jaws defines an aperture extending through said jaw to act as a handle for said utility box.

98. The utility box of claim 97, wherein said aperture is not in communication with said open chamber.

99. The utility box according to claim 76, further comprising at least one support leg connected to said base.

100. The utility box according to claim 76, further comprising a plurality of support legs connected to said base.

101. The utility box according to claim 76, further comprising a drawer support connected to said base.

102. A utility box comprising:

a generally rectangular base defining an open chamber for holding at least one article;

a clamping vise secured to said base, said clamping vise forming a cover for closing said open chamber and having a worksurface defining a plurality of holes; and at least one peg removably disposed within one of said plurality of holes, said at least one peg being adapted to interface with a workpiece.

103. The utility box of claim 102, wherein said clamping vise is hingedly secured to said base.

104. The utility box of claim 102, further comprising at least one latch for securing said clamping vise to said base.

105. The utility box of claim 104, wherein said at least one latch is an over-center type of latch.

106. The utility box of claim 102, wherein said base includes at least one clamping foot.

107. The utility box of claim 102, further comprising a parts tray secured to an exterior wall of said base.

108. The utility box of claim 107, wherein said parts tray is accessible when said cover is closed.

109. The utility box of claim 107, wherein said parts tray is integral with said base.

110. The utility box of claim 107, wherein said parts tray includes at least one divider disposed within said tray for separating said parts tray into multiple compartments.

111. The utility box of claim 107, wherein said parts tray includes a cover hingedly secured to said base.

112. The utility box of claim 102 further comprising an auxiliary removable tray disposed within said chamber.

113. The utility box of claim 102, wherein said base defines a plurality of pedestals.

114. The utility box of claim 102, wherein said clamping vise comprises a first jaw fixedly secured to said cover and a second jaw secured to said cover, said second jaw being movable with respect to said first jaw.

115. The utility box of claim 114, wherein said clamping vise includes at least one screw rotatably secured to said cover, said at least one screw being operable to move said second jaw with respect to said first jaw.

116. The utility box according to claim 114, wherein said jaws define said worksurface.

117. The utility box of claim 116, wherein one of said jaws defines an aperture extending through said jaw to act as a handle for said utility box.

118. The utility box of claim 117, wherein said aperture is not in communication with said open chamber.

119. The utility box of claim 102, wherein said clamping vise comprises:

a fixed jaw secured to said base, said fixed jaw defining a fixed clamping face;

a movable jaw secured to said fixed jaw, said movable jaw defining a movable clamping face; and clamping means operatively coupled between said fixed jaw and said movable jaw for moving said movable jaw relative to said fixed jaw to securely hold a workpiece between said clamping faces, said clamping means including means for moving said movable jaw such that said movable clamping face is moved into a substantially non-parallel relationship to said fixed clamping face to facilitate the holding of said workpiece.

120. The utility box of claim 119, wherein said clamping means comprises a pair of independently-operable screw threaded devices and means for coupling each of said devices to said movable jaw for permitting angular movement of said movable jaw relative to each screw threaded device.

121. The utility box according to claim 119, wherein said jaws define said worksurface.

122. The utility box of claim 119, wherein one of said jaws defines an aperture extending through said jaw to act as a handle for said utility box.

123. The utility box of claim 122, wherein said aperture is not in communication with said open chamber.

124. The utility box according to claim 102, further comprising at least one support leg connected to with said base.

125. The utility box according to claim 102, further comprising a plurality of support legs connected to said base.

126. The utility box according to claim 102, further comprising a drawer support connected to said base.

127. A utility box comprising:

a base defining an open chamber for holding at least one article;

a clamping vise connected to said base to form a cover for said open chamber, said clamping vise comprising;

a stationary jaw fixably secured to said base;

a movable jaw connected to said stationary jaw, said movable jaw being movable with respect to said stationary jaw;

a pair of frames fixedly secured to said stationary jaw;

a pair of clamping screws, each clamping screw rotatably supported by a respective frame; and a pair of shuttles connected to said movable jaw, each shuttle threadably engaging a respective clamping screw such that rotation of said respective clamping screw results in movement of said movable jaw relative to said stationary jaw.

128. The utility box of claim 127, wherein said at least one foot includes a bottom wall, said bottom wall defining a generally conical recess to allow accurate positioning of a drill bit.

129. A utility box comprising:

a base defining an open chamber for holding at least one article;

a cover connected to said base, said cover defining a top surface; and a clamping vise comprising over substantially all of said top surface of said cover, said clamping vise defining a worksurface.

130. A utility box comprising:

a base having a floor and defining an open chamber for holding at least one article;

at least one recessed foot extending from said floor, said at least one foot being adapted for securing said base to a supporting surface; and a clamping vise secured to said base, said clamping vise forming a cover for closing said open chamber.

* * * * *

UNITED STATES PATENT AND TRADEMARK OFFICE

CERTIFICATE OF CORRECTION

PATENT NO. : 5,595,228

DATED : January 21, 1997

INVENTOR(S) : Edward H. Meisner et al.

It is certified that error appears in the above-indentified patent and that said Letters Patent is hereby corrected as shown below:

On the Title Page, under "Foreign Patent Documents", United Kingdom Patent No. 2,241,940,
"9/1994" should be --2/1994--.

On the Title Page, in the "Abstract", line 16,
"and" should be --an--.

Column 9, line 21, claim 27,
delete ".".

Column 13, line 34, claim 117,
"116" should be --114--.

Column 14, line 9, claim 124,
delete "with".

Column 14, line 46, claim 129,
delete "over".

Signed and Sealed this

Second Day of September, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,595,228

DATED : January 21, 1997

INVENTOR(S) : Edward H. Meisner et al.

It is certified that error appears in the above-indentified patent and that said Letters Patent is hereby corrected as shown below:

On the title page, item [75], after "Inventors:", "John B. Manson, Sr." should be --John B. Mason, Sr.--

Signed and Sealed this

Fourteenth Day of October, 1997

*Attest:*

*Attesting Officer*

BRUCE LEHMAN

*Commissioner of Patents and Trademarks*